US007255582B1

(12) United States Patent
Liao

(10) Patent No.: US 7,255,582 B1
(45) Date of Patent: Aug. 14, 2007

(54) FOLDABLE USB CONNECTION PORT

(76) Inventor: Sheng-Hsin Liao, No. 10, Alley 38, Lane 229, San Chun St., Shulin City, Taipei Hsien (TW)

( * ) Notice: Subject to any disclaimer, the term of this patent is extended or adjusted under 35 U.S.C. 154(b) by 0 days.

(21) Appl. No.: 11/408,035

(22) Filed: Apr. 21, 2006

(51) Int. Cl.
*H01R 3/00* (2006.01)

(52) U.S. Cl. ..... 439/165

(58) Field of Classification Search ..... 439/165, 439/8, 31, 131, 144, 640
See application file for complete search history.

(56) References Cited

U.S. PATENT DOCUMENTS 5,411,416 A * 5/1995 Balon et al. ..... 439/639
6,193,522 B1 * 2/2001 Liao ..... 439/31
6,754,507 B2 * 6/2004 Takagi ..... 455/550.1
6,758,689 B1 * 7/2004 Bair et al. ..... 439/136
7,121,852 B2 * 10/2006 Ng et al. ..... 439/131
2006/0131431 A1 * 6/2006 Finn ..... 235/492

* cited by examiner

*Primary Examiner*—J. F. Duverne
(74) *Attorney, Agent, or Firm*—Rosenberg, Klein & Lee

(57) ABSTRACT

A foldable USB connection port includes a body and a plurality of USB ports. The body includes a plurality of first connection parts and the USB ports respectively have a second connection part. The second connection parts of the USB ports are respectively and movably installed on the first connection parts of the body. The body is a USB hub or a laptop. Thereby, the user can movably adjust the angle of the USB port to avoid the problem that two adjacent USB ports cannot be plugged with the peripherals simultaneously due to the dimensions of the peripheral.

8 Claims, 12 Drawing Sheets

FOLDABLE USB CONNECTION PORT

BACKGROUND OF THE INVENTION

1. Field of the Invention

The present invention relates to a foldable USB connection port. In particular, this invention relates to a foldable USB connection port that is installed to a USB hub or a laptop and the angle of the USB port is adjustable.

2. Description of the Related Art

As shown in FIG. 1, the USB hub 1*a* of the prior art is disclosed. A plurality of USB ports 12*a* are installed on an appropriate location of a housing 11*a*, and there is a USB control circuit (not shown in the figure) in the housing 11*a*. The USB ports 12*a* are respectively and electrically connected with the control circuit. The USB port 12*a* can be movably plugged with a peripheral 2*a*, such as an MP3 portable disk or a USB optical mouse, etc. Then, the USB hub 1*a* is linked with a laptop 4*a* via one of the USB ports 12*a* and a USB transmission line 3*a*. In this way, the peripheral 2*a* of the laptop 4*a* is expanded.

However, the USB hub 1*a* and the laptop 4*a* only can be movably plugged with the peripheral 2*a* and the USB transmission line 3*a*, etc. When a large sized peripheral 2*a* is plugged with one of the USB ports 12*a*, the adjacent USB port 12*a* cannot be plugged with another peripheral 2*a* due to the large sized peripheral 2*a*. Therefore, the number of the expanded peripherals 2*a* is restricted. Furthermore, the function of expanding the peripheral 2*a* of the USB ports 12*a* is limited due to the dimensions of the peripheral 2*a*.

SUMMARY OF THE INVENTION

One particular aspect of the present invention is to provide a foldable USB connection port. The user can movably adjust the angle of the USB port. When one USB port is plugged with a peripheral and an adjacent USB port is plugged with another peripheral, these two USB ports are adjustable so they can be located in different directions. Therefore, the problem of it not being possible for two adjacent USB ports to be plugged with the peripherals simultaneously due to the dimensions of the peripheral can be avoided.

The foldable USB connection port includes a body having a plurality of first connection parts, and a plurality of USB ports that respectively has a second connection part. The second connection parts of the USB ports are respectively and movably installed on the first connection parts of the body.

For further understanding of the invention, reference is made to the following detailed description illustrating the embodiments and examples of the invention. The description is only for illustrating the invention and is not intended to be considered limiting of the scope of the claim.

BRIEF DESCRIPTION OF THE DRAWINGS

The drawings included herein provide a further understanding of the invention. A brief introduction of the drawings is as follows.

DETAILED DESCRIPTION OF THE PREFERRED EMBODIMENTS

Figure 1:
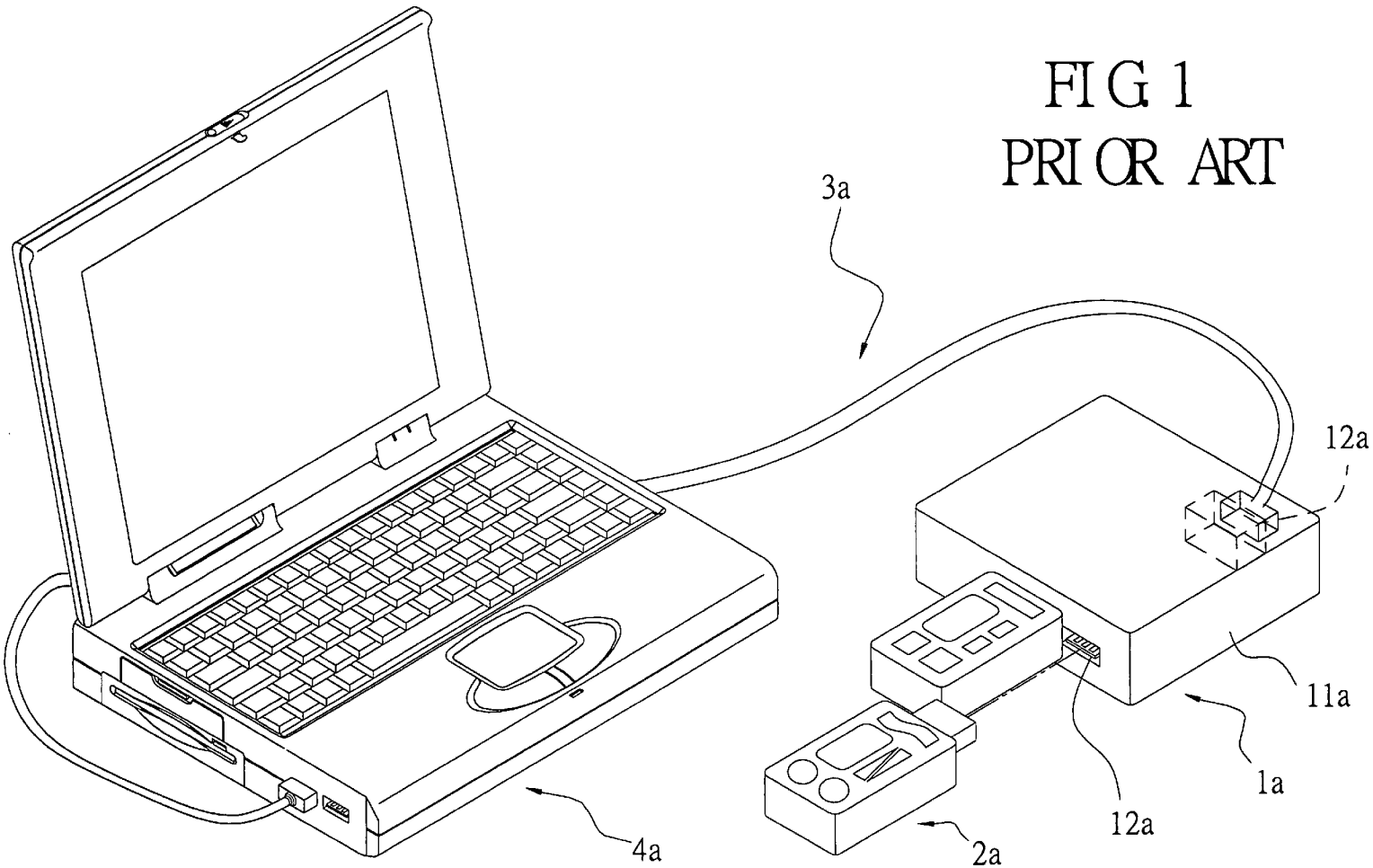
FIG 1 PRIOR ART
FIG. 1 is a schematic diagram of the usage status of the USB hub of the prior art.
Figure 2:
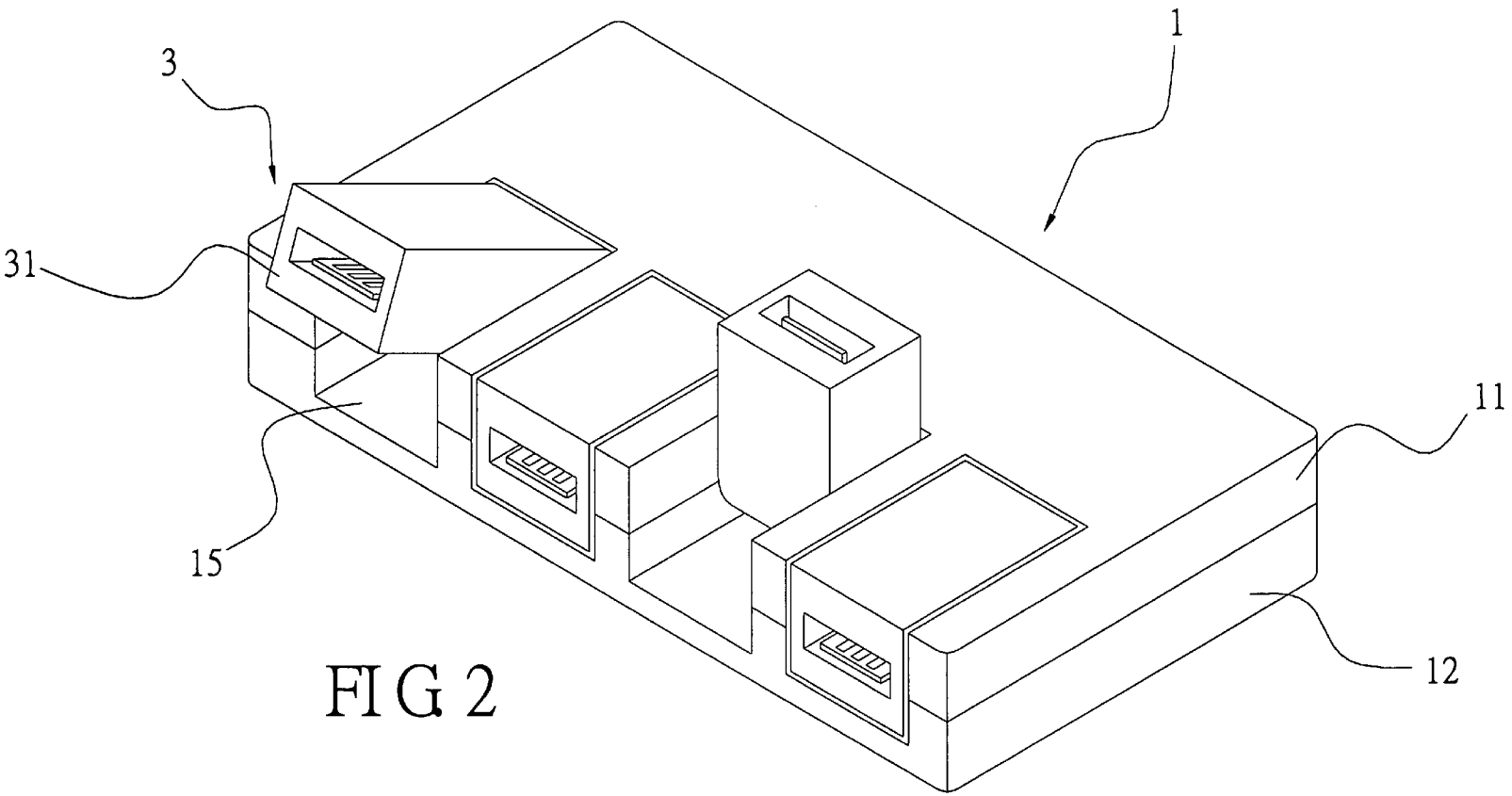
FIG. 2 is a perspective view of the first embodiment of the body of the present invention.
Figure 8:
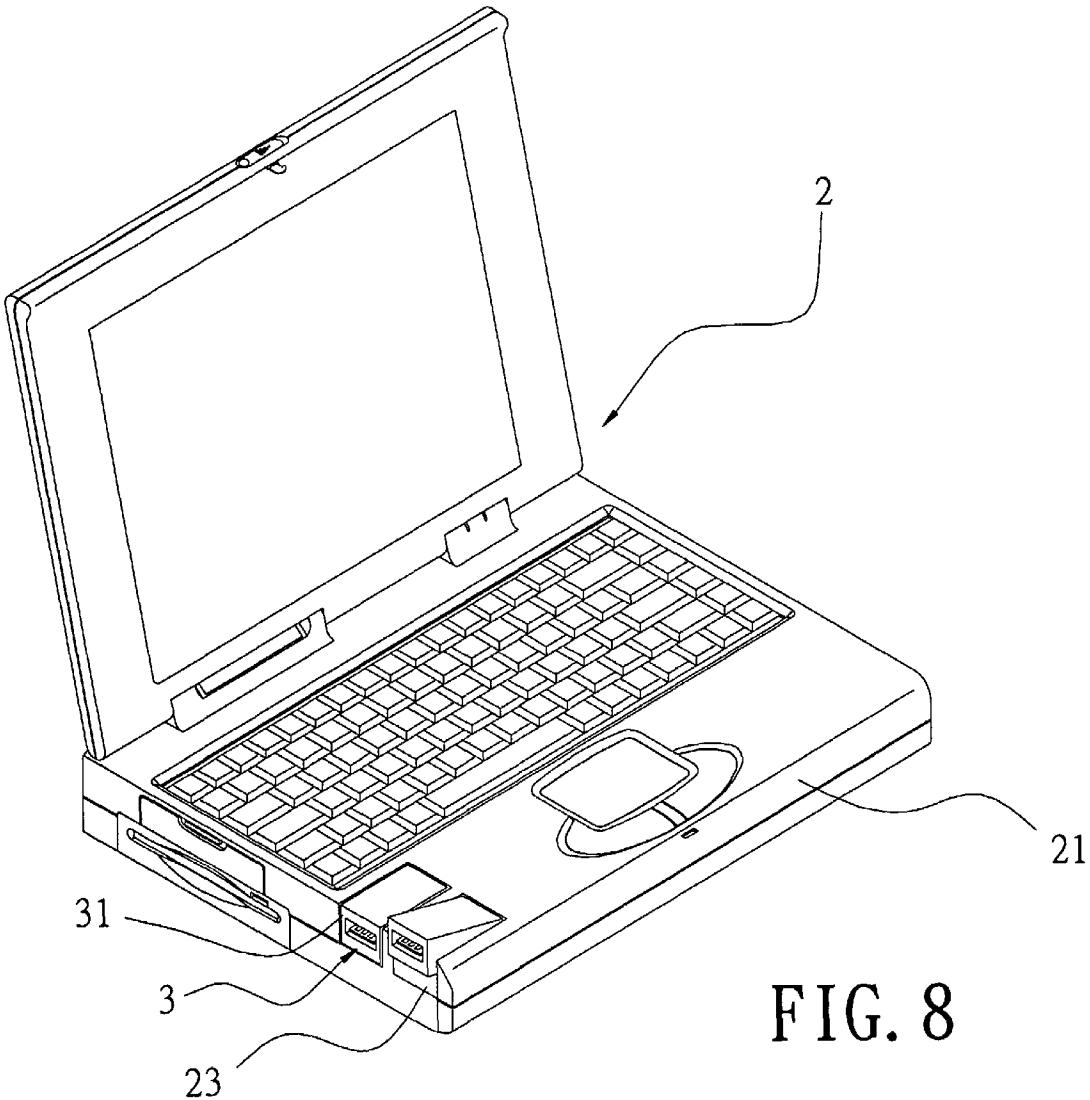
FIG. 8 is a perspective view of the second embodiment of the body of the present invention.
Figure 9:
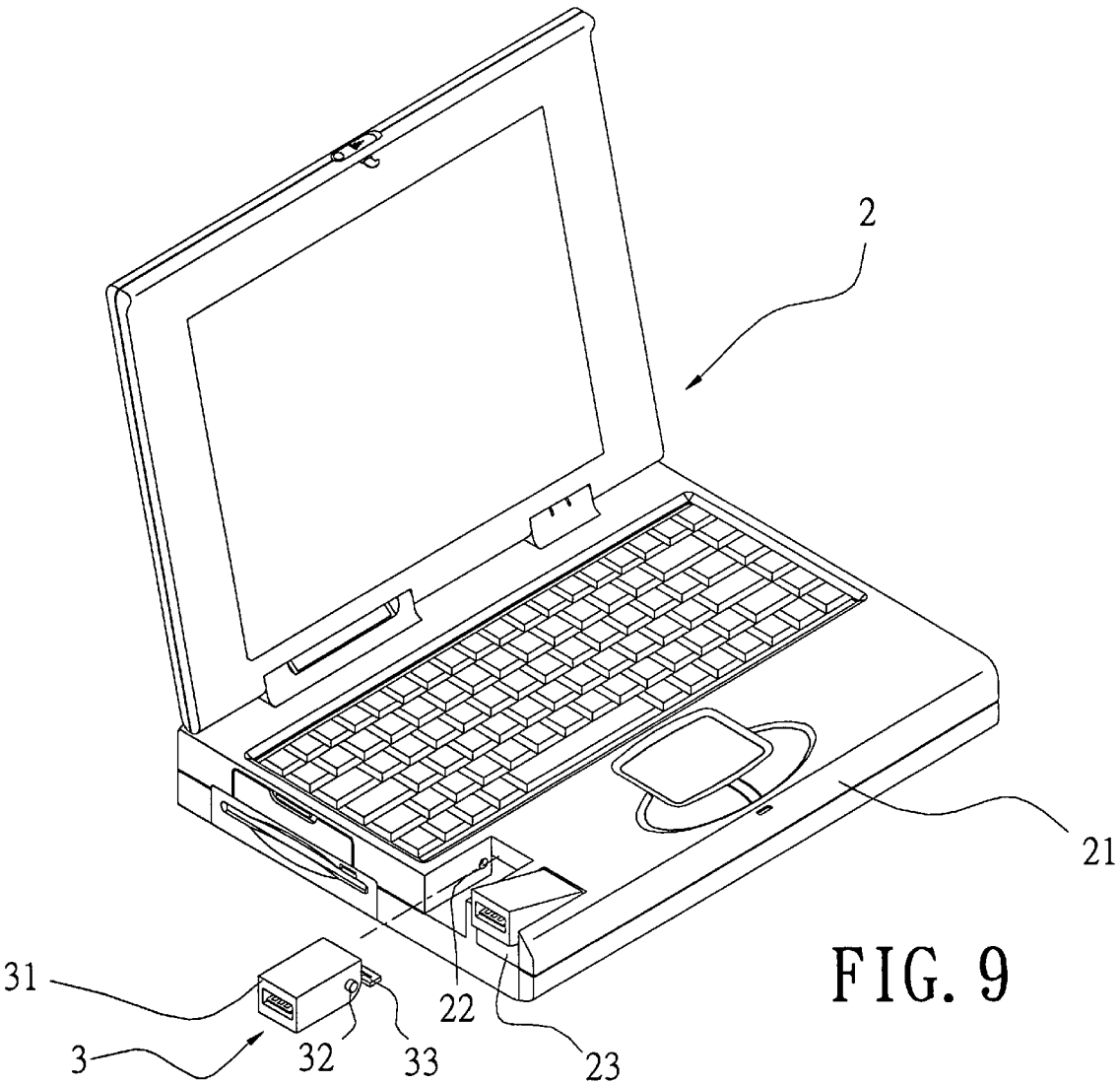
FIG. 9 is a part exploded perspective view of the second embodiment of the body of the present invention.
Figure 10:
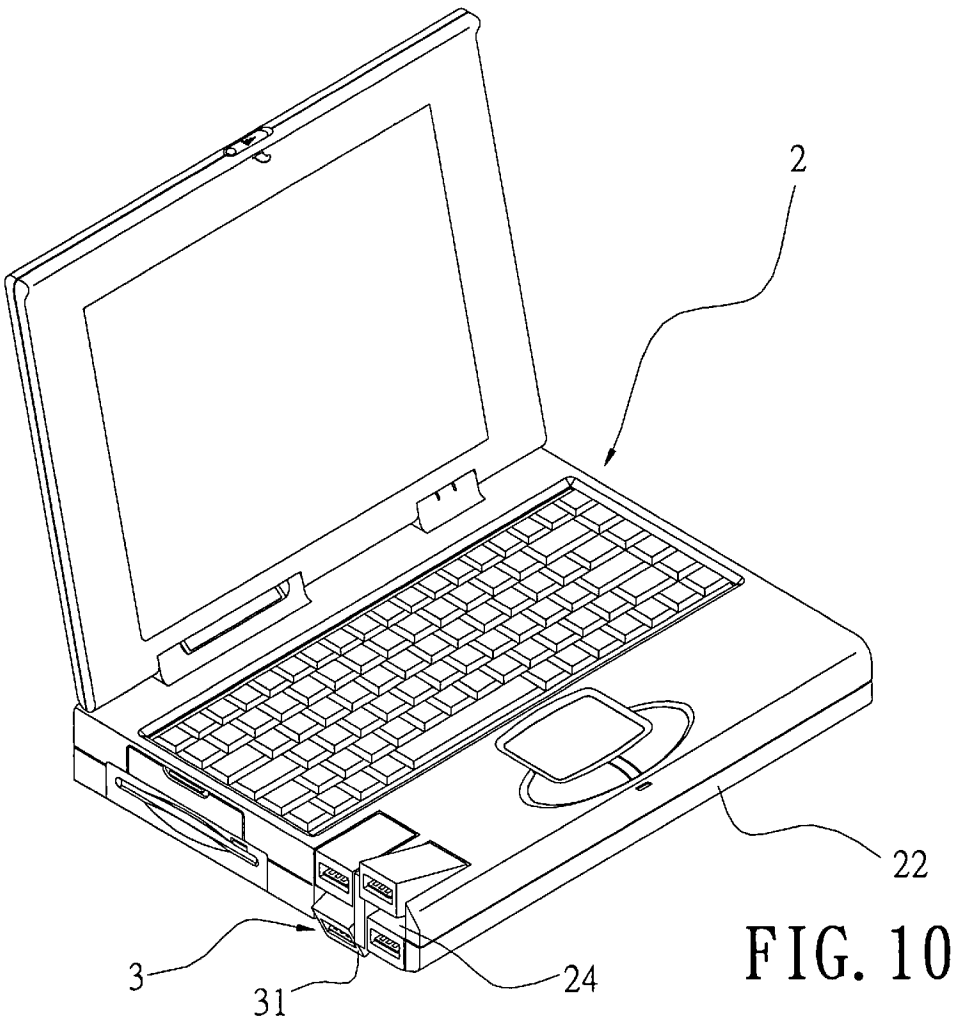
FIG. 10 is another perspective view of the second embodiment of the body of the present invention.
Figure 11:
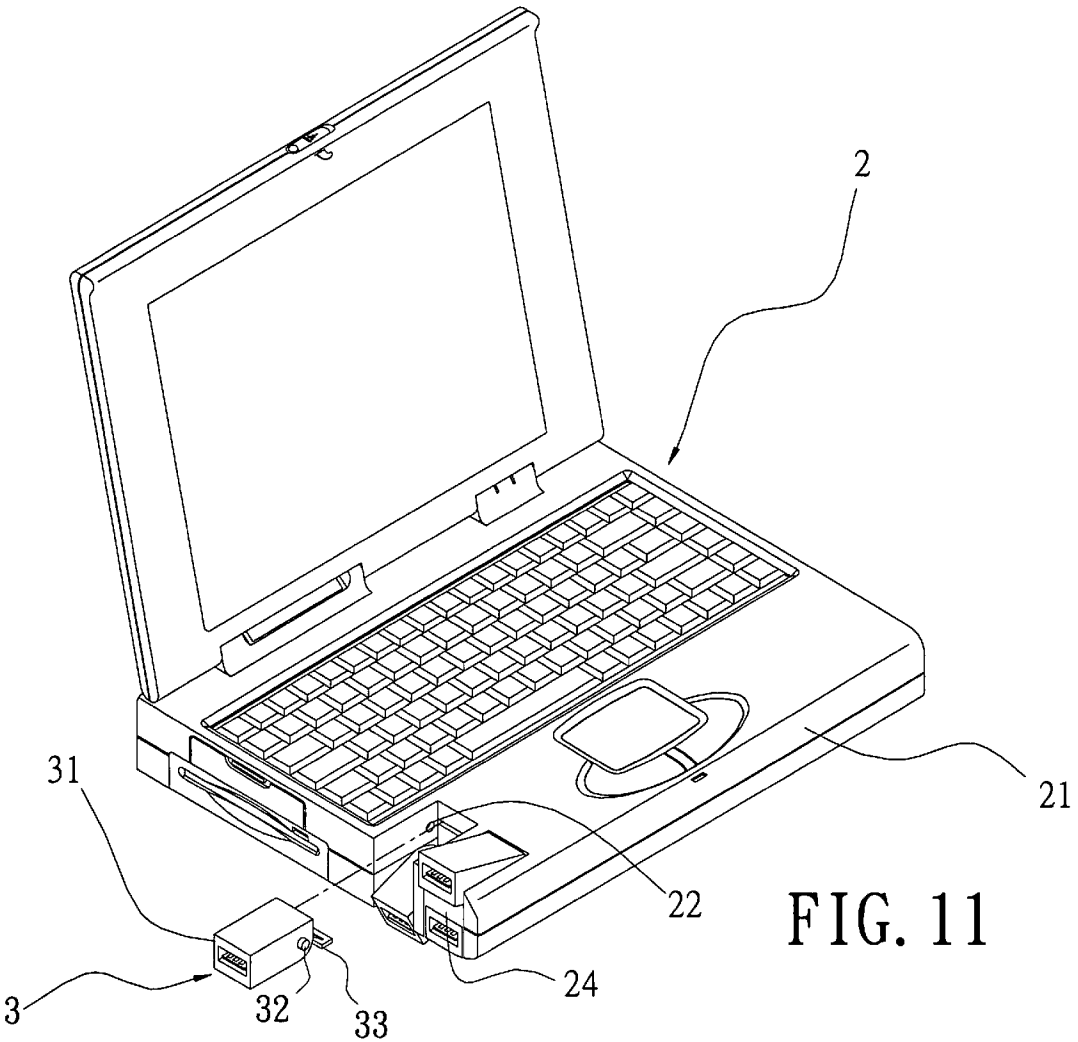
FIG. 11 is another part exploded perspective view of the second embodiment of the body of the present invention.

Reference is made to FIG. 2 and FIG. 8. The foldable USB connection port includes a body and a plurality of USB ports 3. The body can be a USB hub 1 or a laptop 2.

Figure 4:
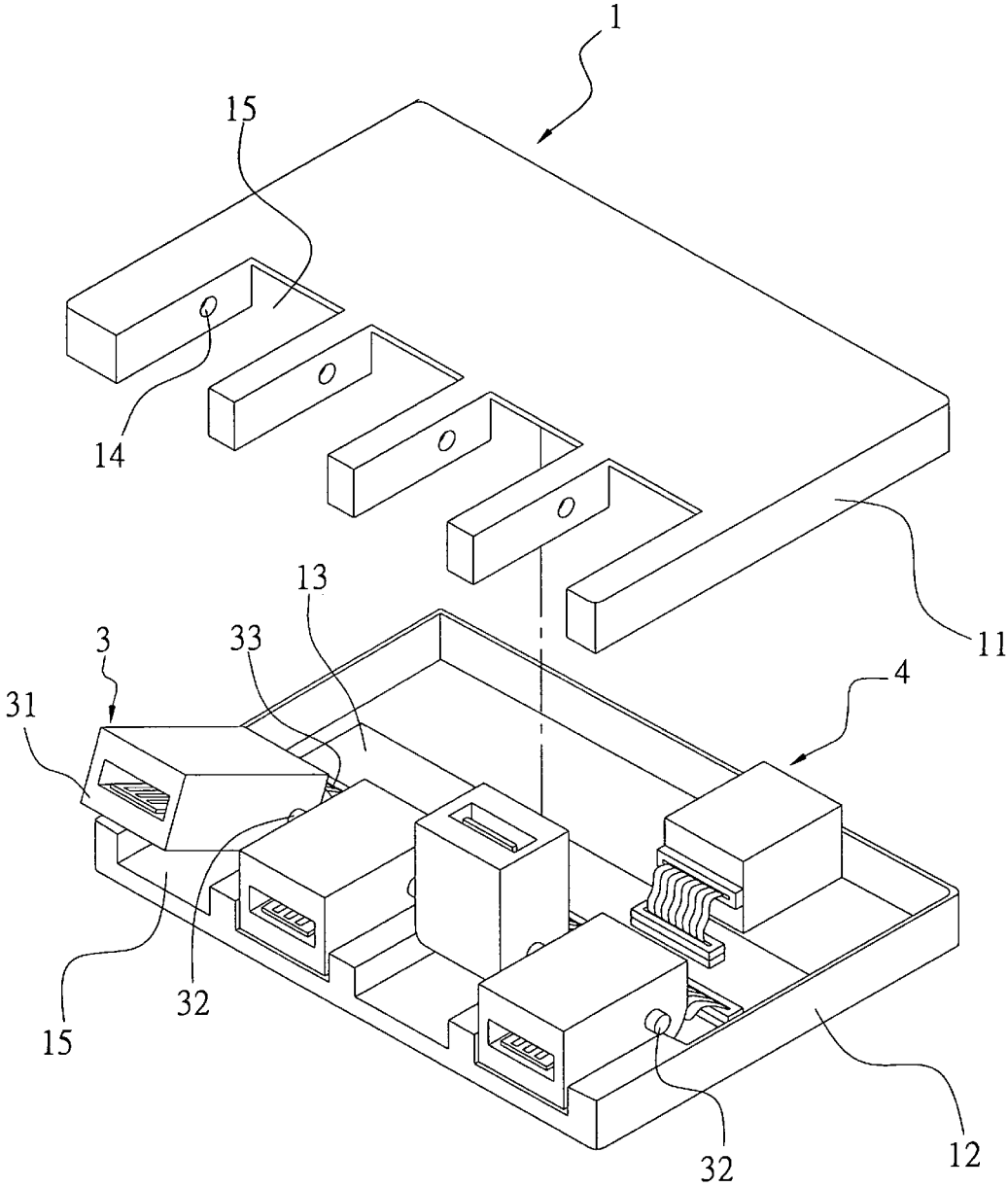
FIG. 4 is a second exploded perspective view of the first embodiment of the body of the present invention.
Figure 5:
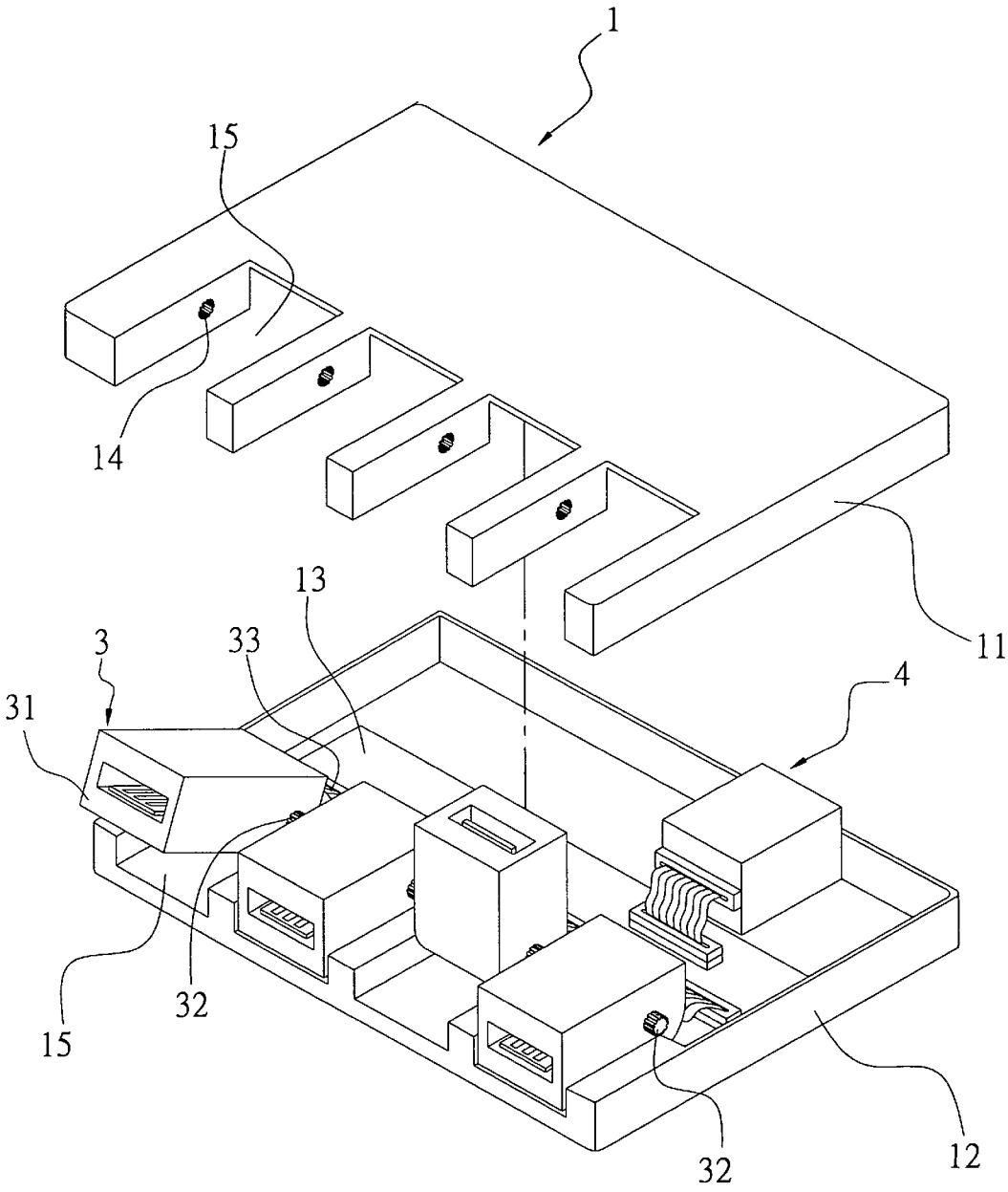
FIG. 5 is a third exploded perspective view of the first embodiment of the body of the present invention.
Figure 6:
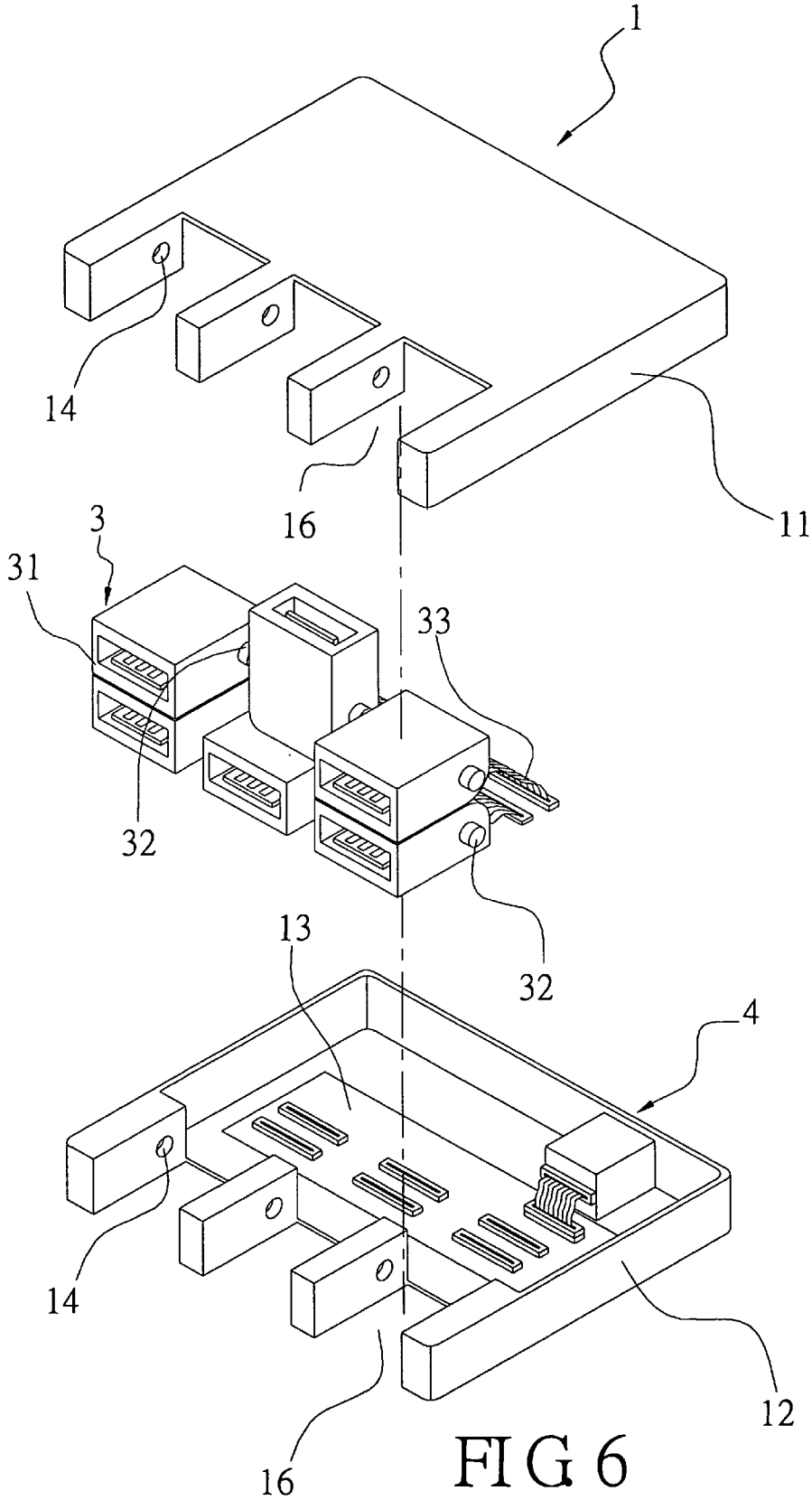
FIG. 6 is a fourth exploded perspective view of the first embodiment of the body of the present invention.
Figure 7:
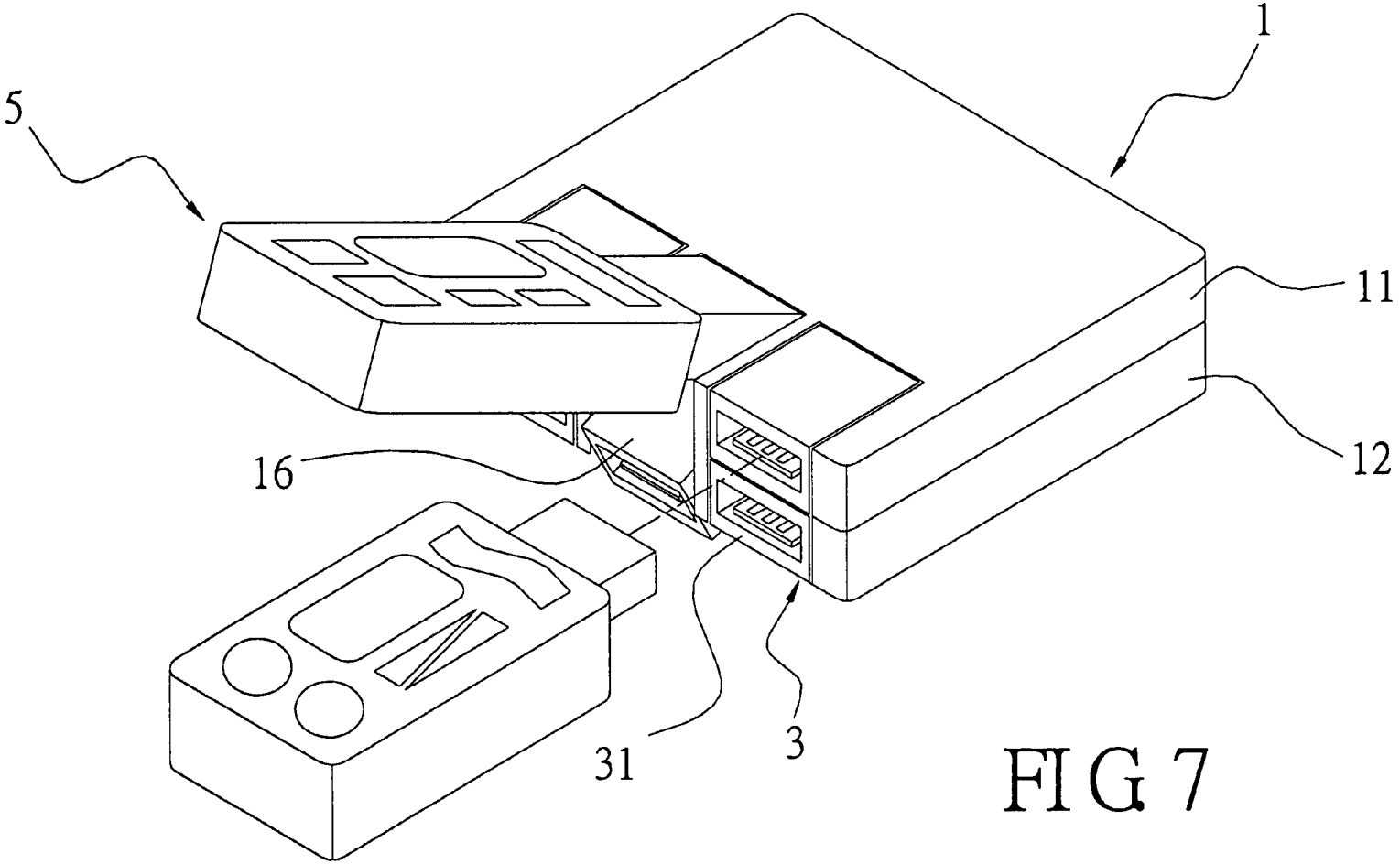
FIG. 7 is an assembly perspective view of FIG. 6.

FIGS. 2 to 7 show a first embodiment of the body of the present invention. The body is a USB hub 1. The USB hub 1 is composed of an upper shell body 11 and a lower shell body 12, and has a square-box shape. There is a USB control circuit 13 received in the USB hub 1 and fastened on the lower shell body 12. The USB hub 1 includes a plurality of first connection parts 14. A concave slot 15 is formed at an appropriate location on the USB hub 1, and the concave slot 15 is formed from the upper shell body 11 to the lower shell body 12. The first connection parts 14 are respectively located on the wall of the concave slots 15. Alternatively, a plurality of opening slots 16 are formed at an appropriate location on the USB hub 1, and the opening slot 16 is formed from the upper shell body 11 to the lower shell body 12. The opening slot 16 is hollow (as shown in FIG. 6 and FIG. 7). The first connection parts 14 are respectively located on the wall of the opening slots 16. Moreover, on the wall of the opening slots 16, there can be two sets of the first connection parts 14. The first connection parts 14 are columns, circular holes, thorn gears, or thorn gear holes. The first connection parts 14 are composed of a pair of columns, circular holes, thorn gears, or thorn gear holes that are respectively and oppositely located on the wall of the concave slot 15 or the opening slot 16 of the USB hub 1.

Figure 3:
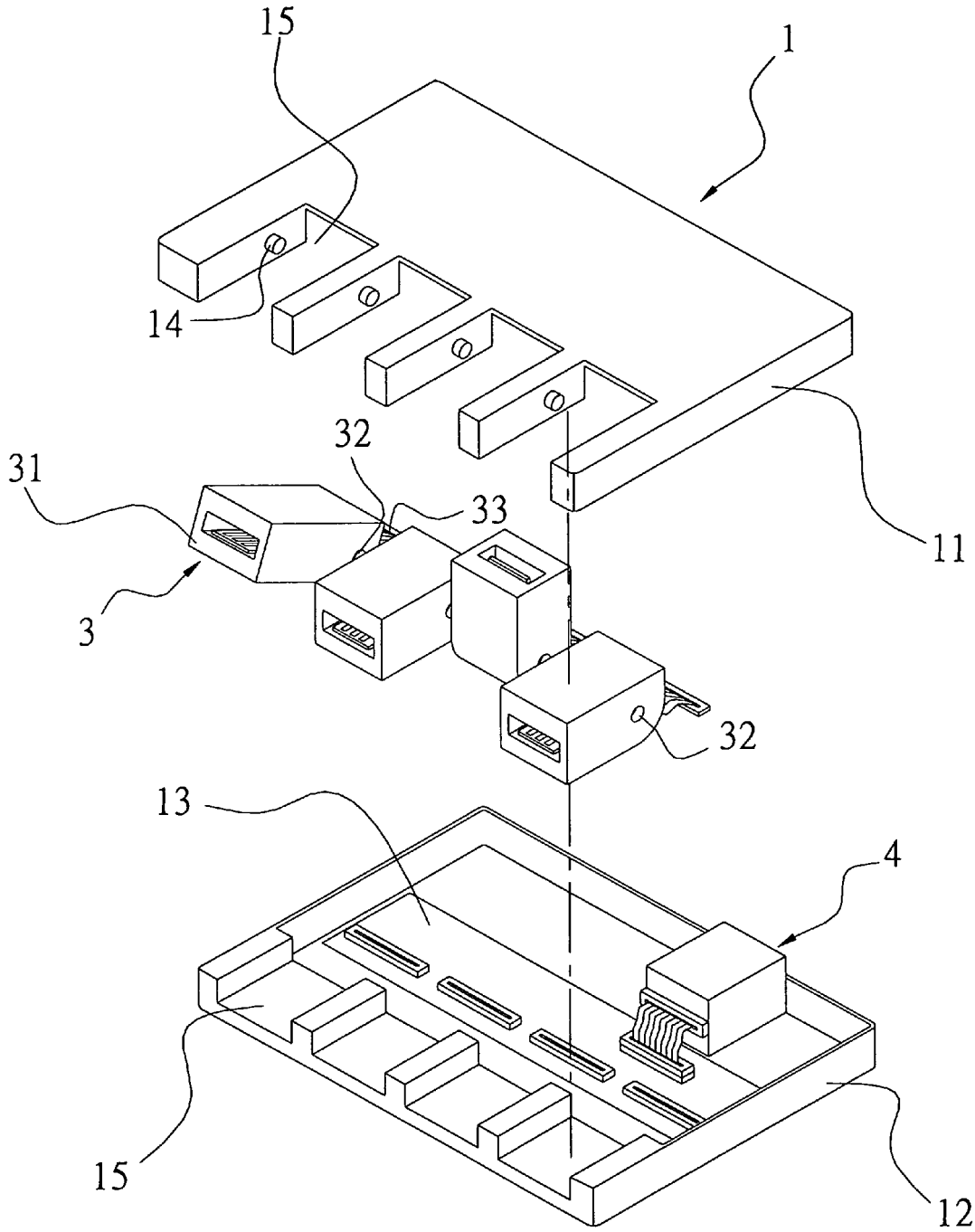
FIG. 3 is a first exploded perspective view of the first embodiment of the body of the present invention.

The USB ports 3 are wrapped with an insulating shell body 31, such as a plastic material. The USB port can be a USB2.0 or a Mini USB. The USB ports 3 respectively have a second connection part 32. The second connection part 32 of the USB ports 3 can be columns, circular holes, thorn gears, or thorn gear holes (as shown in FIGS. 3, 4 and 5). The second connection part 32 is composed of a pair of columns, circular holes, thorn gears, or thorn gear holes that are respectively located on the opposite right side and the left side of the USB ports 3. On the rear of the USB ports 3, there is a transmission device 33, such as a bus, a conducting line, or a pin. The transmission devices 33 of the USB ports 3 are respectively and electrically connected to the USB control circuit 13 of the USB hub 1.

The second connection part 32 of the USB ports 3 are respectively and movably installed on the first connection parts 14 of the USB hub 1. If the second connection part 32 is a circular hole, then the first connection part 14 is a column. If the second connection part 32 is a thorn gear, then the first connection part 14 is a thorn gear hole. The first connection part 14 is wedged into the second connection part 32 so that the USB port 3 can be moved upward and downward on the USB hub 1 to adjust its location angle (as shown in FIG. 2). For another embodiment, a pair of USB ports 3 (as shown in FIG. 7) are located on the upper side and lower side of the USB hub 1 according to the user's requirement. Therefore, the number of the USB ports is increased.

Furthermore, there is an upload USB port 4 on the USB hub 1. The upload USB port 4 is located at an appropriate location of the lower shell body 12 of the USB hub 1, and electrically connected with the USB control circuit 13 so that the USB ports 3 are linked with the upload USB port 4. Alternatively, the upload USB port 4 is movably installed on the USB hub 1. As described above, the upload USB port 4 is movably installed on the USB hub 1 that is same as the USB ports 3.

FIGS. 8 to 11 show a second embodiment of the body of the present invention. The body is a laptop 2. There are a plurality of first connection parts 22 on the shell body 21 of the keyboard of the laptop 2. A plurality of concave slots 23 are formed at appropriate locations of the shell body 21 of the on the concave slots 23. Alternatively, a plurality of opening slots 24 are formed at an appropriate location of the shell body 21. The first connection parts 22 are respectively located on the opening slots 24. The first connection parts 14 are composed of a pair of columns, circular holes, thorn gears, or thorn gear holes that are respectively and oppositely located on the wall of the concave slot 24 or the opening slot 24. The second connection part 32 of the USB ports 3 is respectively and movably located on the first connection part 22 of the shell body 21 of the laptop 2 so as to provide the same function described in the above sections. The transmission device 33 of the USB ports 3 is respectively and electrically connected to the motherboard in the laptop 2. Thereby, the USB ports 3 are linked with the laptop 2.

Figure 12:
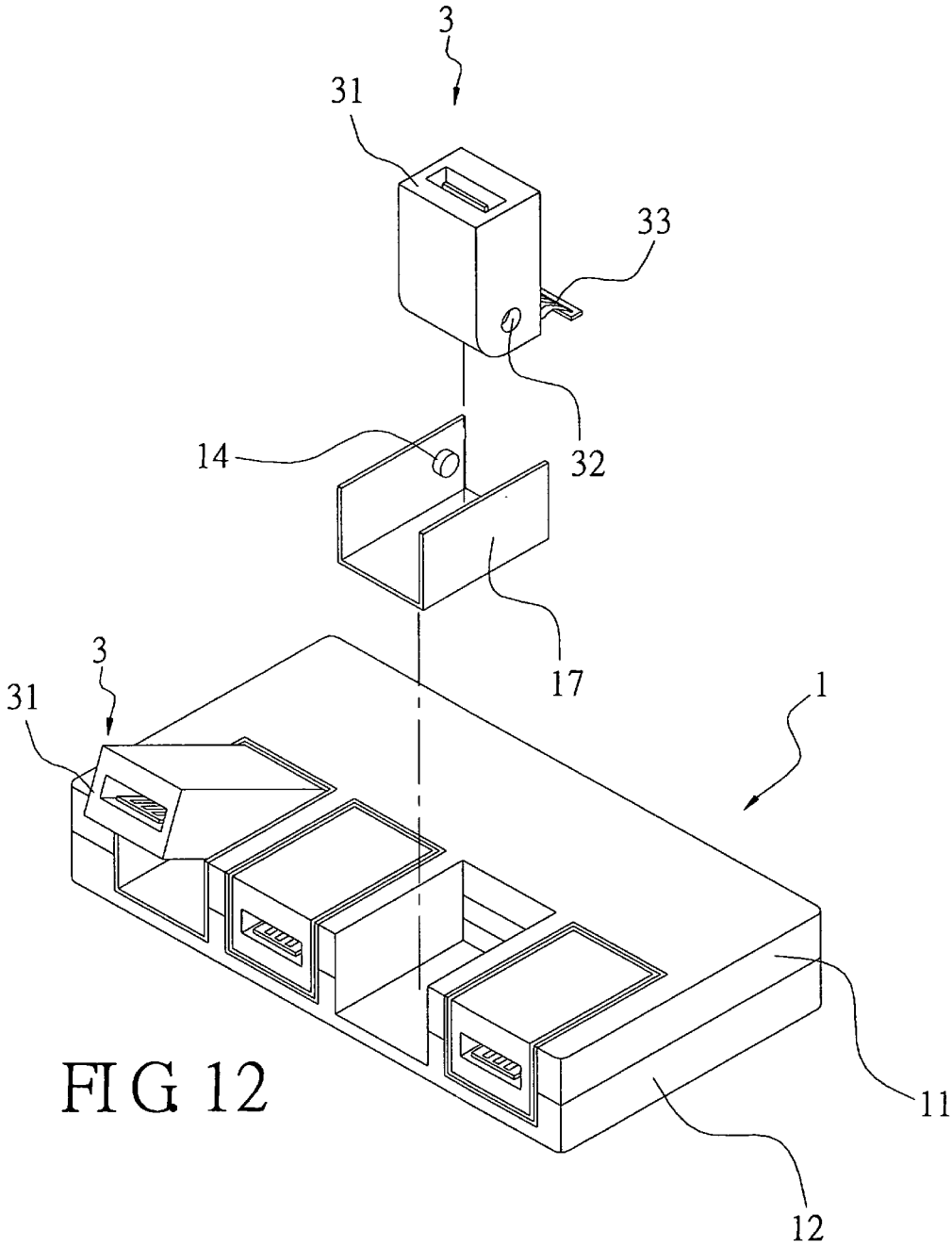
FIG. 12 is an exploded perspective view of the body of the present invention that is installed with a base.

As shown in FIG. 12, the body 12 (such as the USB hub 1) further includes a plurality of bases 17. The base 17 has a U-shape. The first connection parts 14 are respectively located on the wall of the bases 17. The second connection part 32 of the USB ports 3 are respectively installed on the first connection part 12 of the bases 17. The bases 17 can be fastened on the body, or can be movably installed on the body.

The present invention movably installs the USB ports 3 on the body 1 (such as the USB hub 1, or the laptop 2) so that the user can movably adjust the angle of the USB ports 3. When one USB port 3 is plugged with a peripheral 5 (as shown in FIG. 7) and an adjacent USB port 3 is plugged with another peripheral 5, these two adjacent USB ports 3 are adjustable and can therefore be located in different directions. Therefore, the problem that two adjacent USB ports 3 cannot be plugged with the peripherals simultaneously due to the dimensions of the peripheral can be avoided.

The description above only illustrates specific embodiments and examples of the invention. The invention should therefore cover various modifications and variations made to the herein-described structure and operations of the invention, provided they fall within the scope of the invention as defined in the following appended claims.

What is claimed is:

1. A foldable USB connection port, comprising:

a body having a plurality of recesses formed therein, each of the recesses having a pair of first connection parts respectively formed on opposing sides thereof; and a plurality of USB ports respectively disposed in the plurality of recesses of the body, each of the USB ports having a pair of second connection parts respectively disposed on opposing sides thereof and pivotally coupled to the first connection parts of a corresponding recess of the body, each USB port being angularly displaceable relative to the body through a certain angular extent, each USB port having a transmission device extending from a rear portion of the USB port and electrically coupled thereto, each transmission device having a distal end connected to a USB control circuit in the body to permit data transmission between a corresponding USB port and the USB control circuit throughout the angular extent of the displacement of the USB port.

2. The foldable USB connection port as claimed in claim 1, wherein the body is a USB hub, and the USB hub comprises an upload USB port, wherein the upload USB port is one of fastened on the USB hub or movably installed on the USB hub.

3. The foldable USB connection port as claimed in claim 1, wherein the body is a laptop computer.

4. The foldable USB connection port as claimed in claim 1, wherein the first connection parts are columns, circular holes, thorn gears, or thorn gear holes, wherein the first connection parts are composed of a pair of columns, circular holes, thorn gears, or thorn gear holes that are respectively and oppositely located on the body.

5. The foldable USB connection port as claimed in claim 1, wherein the USB port is a USB 2.0 port or a Mini USB port.

6. The foldable USB connection port as claimed in claim 1, wherein the transmission device is one of a bus, a conducting line, or a pin.

7. The foldable USB connection port as claimed in claim 1, wherein the second connection parts are columns, circular holes, thorn gears, or thorn gear holes, wherein the second connection parts are composed of a pair of columns, circular holes, thorn gears, or thorn gear holes that are respectively and oppositely located on the two sides of the USB ports.

8. A foldable USB connection port, comprising:

a body having a plurality of recesses formed therein;

a plurality of U-shaped bases respectively disposed in the plurality of recesses and removably coupled to the body, each of the bases having a pair of first connection parts respectively formed on opposing inner sides thereof; and a plurality of USB ports respectively disposed between the inner sides of a respective one of the bases, each of the USB ports having a pair of second connection parts respectively disposed on opposing sides thereof and pivotally coupled to the first connection parts of a corresponding base, each USB port being angularly displaceable relative to the body.

* * * * *